US005673463A

United States Patent [19]

Chih-wen

[11] Patent Number: 5,673,463

[45] Date of Patent: Oct. 7, 1997

[54] BELT WITH A MICRO-ADJUSTMENT BUCKLE

[76] Inventor: Chang Chih-wen, Suite 2, 7F, No. 95-8, Chang Ping Road, Sec. 1, Taichung, Taiwan

[21] Appl. No.: 523,158

[22] Filed: Sep. 5, 1995

[51] Int. Cl.[6] ..... A44B 11/22

[52] U.S. Cl. ..... 24/265 BC; 24/173

[58] Field of Search ..... 24/173, 265 BC, 24/308, 309

[56] References Cited

U.S. PATENT DOCUMENTS

| | | | |
|---|---|---|---|
| 912,865 | 2/1909 | Mallard | 24/265 BC |
| 1,022,508 | 4/1912 | Rust | 24/265 BC |
| 1,969,582 | 8/1934 | Rosenblum | 24/265 BC X |
| 2,219,756 | 10/1940 | Sokolof | 24/265 BC |
| 5,077,866 | 1/1992 | Tsai | 24/265 BC X |

*Primary Examiner*—James R. Brittain

[57] ABSTRACT

A belt with micro-adjustment buckle includes a male buckle and a female buckle. The male buckle means consists of a serrated plate and a securing element provided at an end of the serrated plate. An end of the belt is inserted through a securing element of the male buckle to lie flat against an inner side or outer side of the serrated plate which is fitted through a micro-adjustment frame of the female buckle and retained therein.

3 Claims, 6 Drawing Sheets

BELT WITH A MICRO-ADJUSTMENT BUCKLE

BACKGROUND OF THE INVENTION

The present invention relates to a belt structure, and more particularly to a belt with micro-adjustment buckle means.

In conventional belts, the buckle is secured at an end of the belt by screws or other means, and a plurality of punch holes are appropriately spaced apart in the belt tip. The belt is fastened by inserting a tongue of the buckle into a suitable punch hole. But after the user has fastened his belt, stress will concentrate around the punch hole due to the pressure exerted by his abdomen, so that the part of the belt around the hole cracks. Even if the belt is made of very tough leather, the punch holes may also deform or become larger. Furthermore, as the punch holes are appropriately spaced apart, they may not fit the waist of the user any time, especially after a meal. If the user feels the belt to be too tight and wants to loosen the belt by one punch hole, the belt may become too loose. To overcome the above-mentioned drawback, some manufacturers have provided eyelets on the punch holes as reinforcement, but these eyelets will also drop after a period of time. Some manufacturers have designed thicker belts, but this means higher costs. A good solution to the above problem is therefore necessary.

SUMMARY OF THE INVENTION

A primary object of the present invention is to provide a belt with micro-adjustment buckle means whereby the user may slightly adjust the belt to a desired size.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
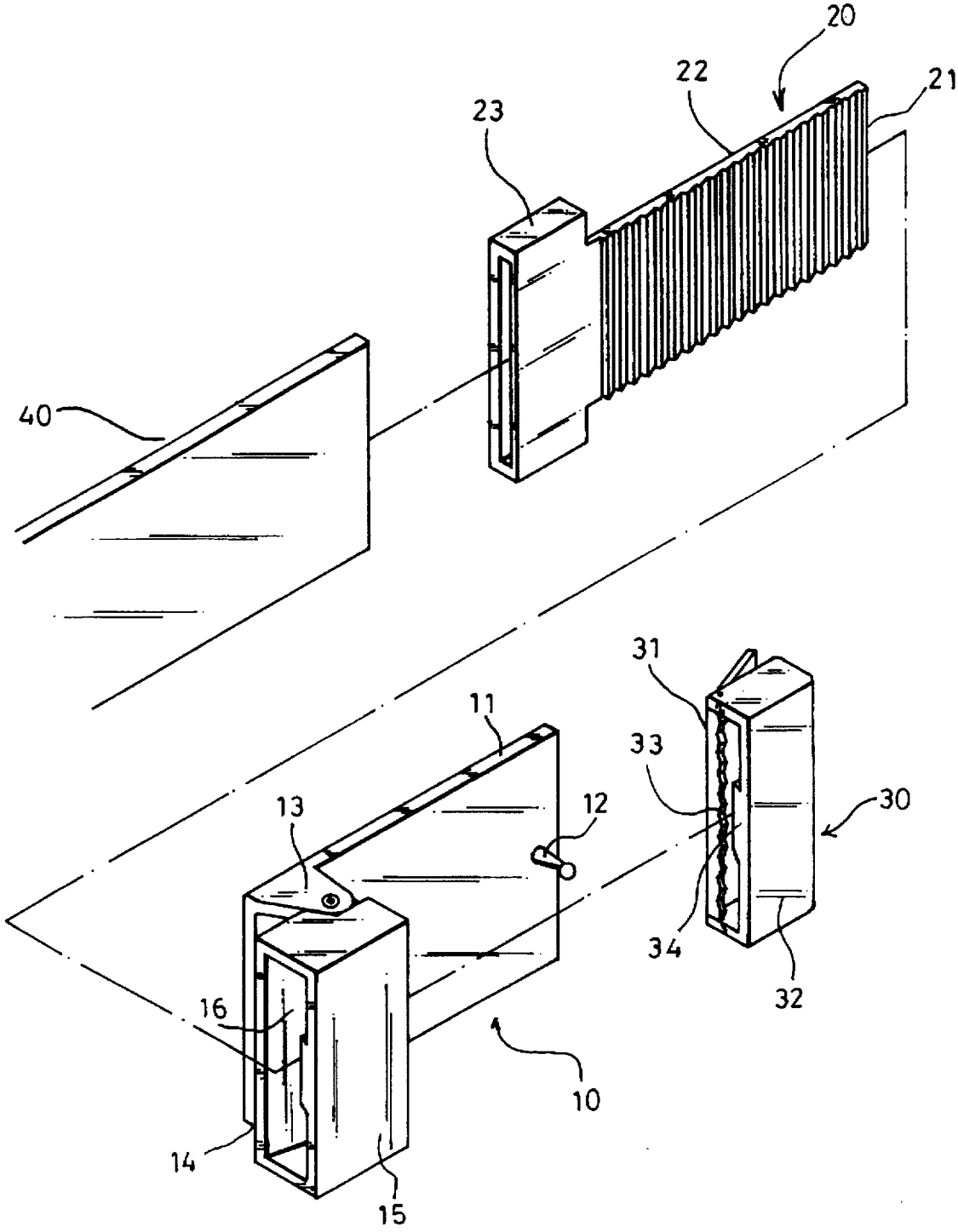
FIG. 1 shows the arrangement of the components of the belt according to the present invention.
Figure 2:
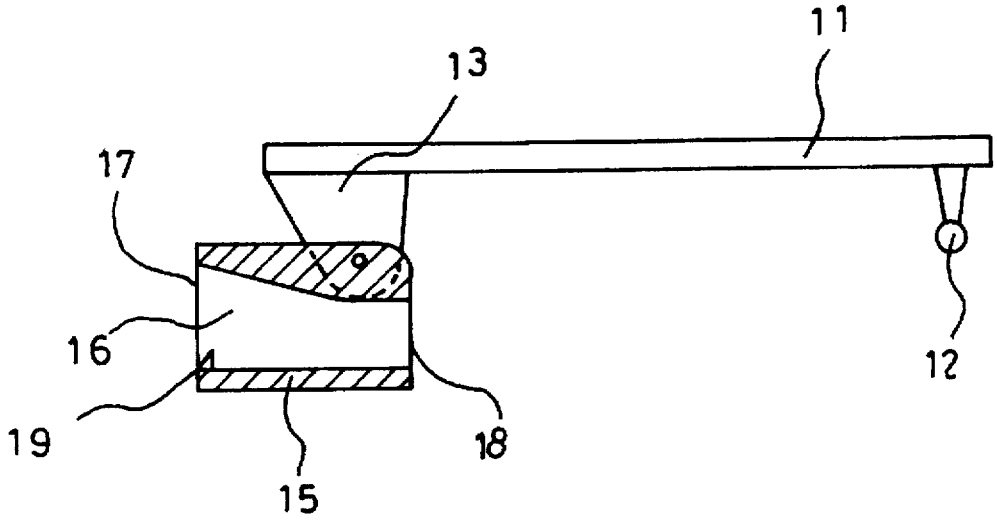
FIG. 2 is a sectional view of a male micro-adjustment buckle means of the present invention.

With reference to FIG. 1, the belt according to the present invention chiefly comprises a female micro-adjustment buckle means 10, a male micro-adjustment buckle means 20 and a fastener 30. The female micro-adjustment buckle means 10 has a pin 12 at a front end of a buckle plate 11. Two lugs 13, 14 are provided at a rear portion of the buckle plate 11 of the female micro-adjustment buckle means 10 to be pivotally connected to a micro-adjustment frame 15. The micro-adjustment frame 15 is substantially rectangular in shape and has a hollow interior 16 (see FIG. 2). The hollow interior 16 inclines outwardly from an inlet end 17 of a comparatively greater diameter to an outlet end 18 of a comparatively smaller diameter. A retainer 19 having a slanting side is provided at the inlet end 17 for engaging the male micro-adjustment buckle means 20.

The male micro-adjustment buckle means 20 (as shown in FIG. 1) includes a serrated plate 22 consisting of a multiplicity of oblique teeth 21, and a securing head 23 having a hollow interior disposed at a front end of the male micro-adjustment buckle means 20. The securing head 23 is fitted onto the belt 40. The fastener 30 is used to secure the end of the belt 40 and a rear end portion of the serrated plate 22 of the male micro-adjustment buckle means 20 together. The fastener 30 includes a locking plate 31 pivotally connected to an inverted U-shaped frame 32, so that a plurality of engaging teeth 34 on the locking plate 31 firmly retain the belt 40 and the male micro-adjustment buckle means 20. The frame 32 further has inverted teeth 34 for engaging the end portion of the serrated plate 22 of the male micro-adjustment buckle means 20.

Figure 4:
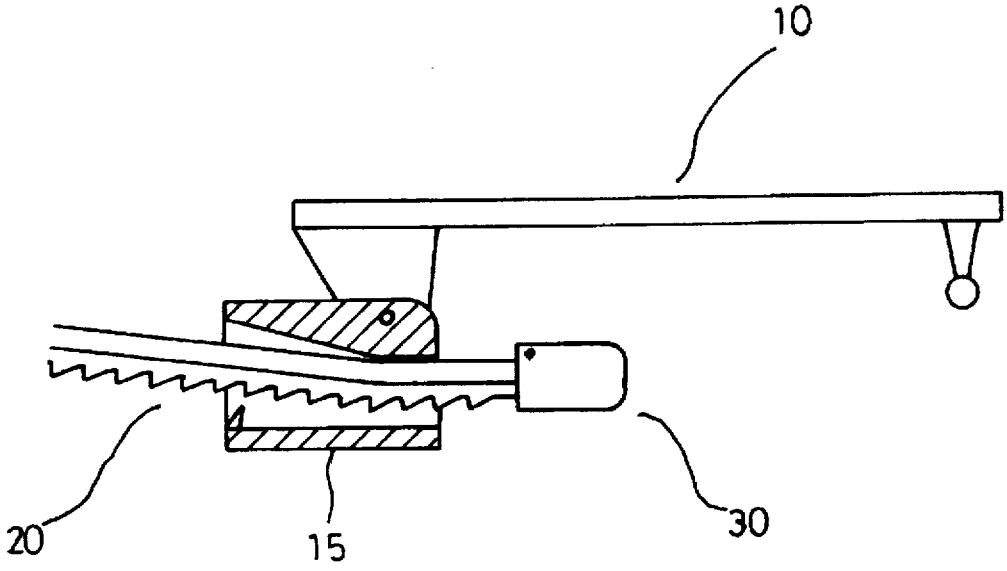
FIG. 4 is a schematic view of a male micro-adjustment buckle means of the present invention.
Figure 3:
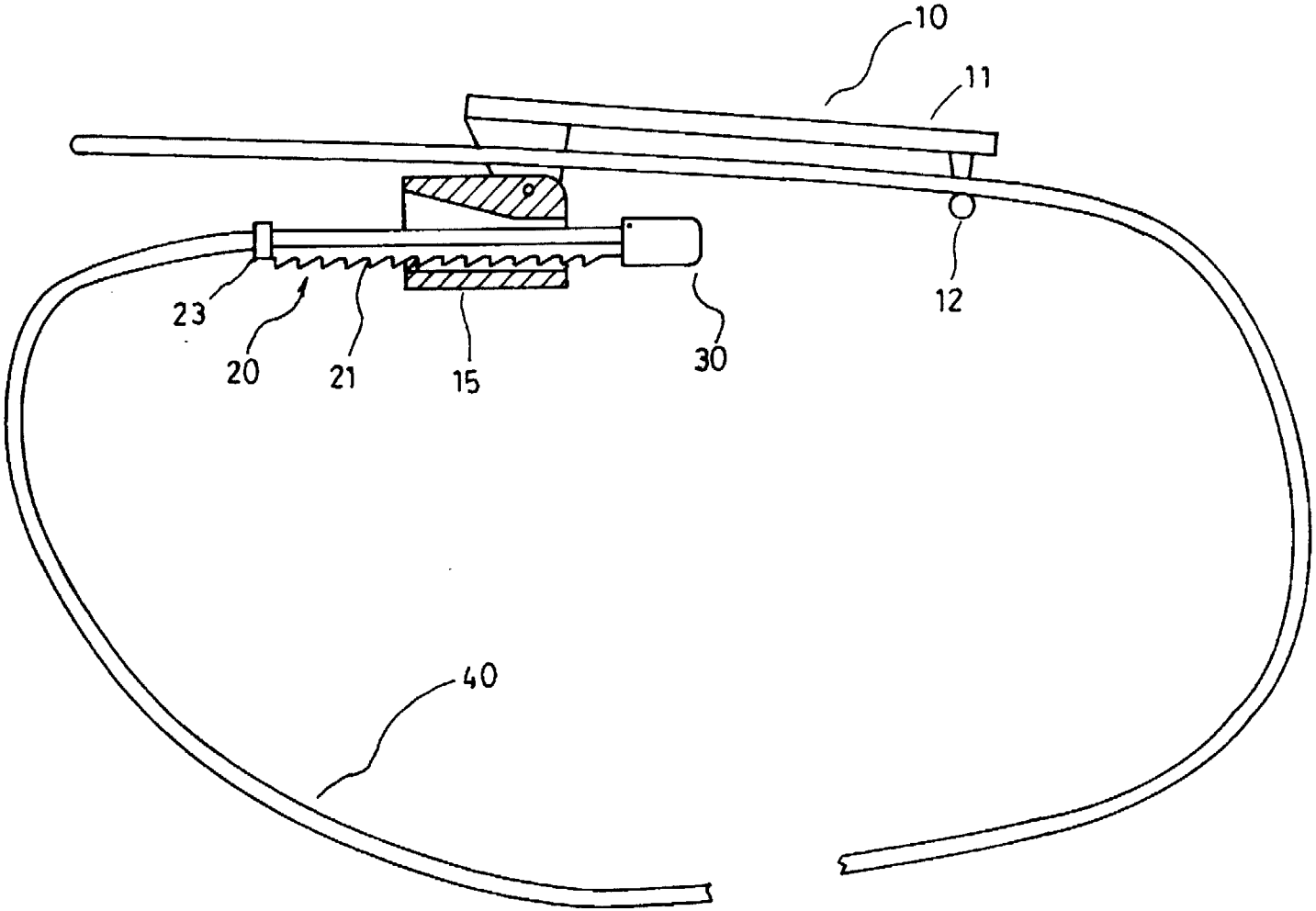
FIG. 3 is a plan view of the belt of the present invention in an assembled state.

With reference to FIGS. 3 and 4, the belt 40 is firstly inserted through the securing head 23 at the front end of serrated plate 22 of the male micro-adjustment buckle means 20 such that the end of the belt 40 flushes with the end of the serrated plate 22 of the male micro-adjustment buckle means 20. The belt 40 and the male micro-adjustment buckle means 20 are then passed through the micro-adjustment frame 15 pivotally connected to the buckle plate 11 of the female micro-adjustment buckle means 10, and the fastener 30 is used to fasten them together firmly. When in use, the pin 12 on the buckle plate 11 of the female micro-adjustment buckle means 10 is fitted into one of a plurality of punch holes appropriately spaced apart in the belt tip as desired. If the belt is too loose, the fastener 30 may be moved inwardly to a suitable position. Conversely, if the belt is too tight, it is only necessary to press the female micro-adjustment buckle means 10 with the index finger and move the male micro-adjustment buckle means 20 upwardly and rearwardly with the thumb to adjust the tightness of the belt. Since the belt is subjected to the pressure exerted thereon by the user's abdomen, the teeth 21 of the male micro-adjustment buckle means 20 and the retainer 19 of the micro-adjustment means 10 may intimately engage with each other. Besides, as the retainer 19 is configured to have a slanting side for retaining the male micro-adjustment buckle means 20, disengagement of the male micro-adjustment buckle means 20 from the micro-adjustment frame 15 is prevented.

Figure 5:
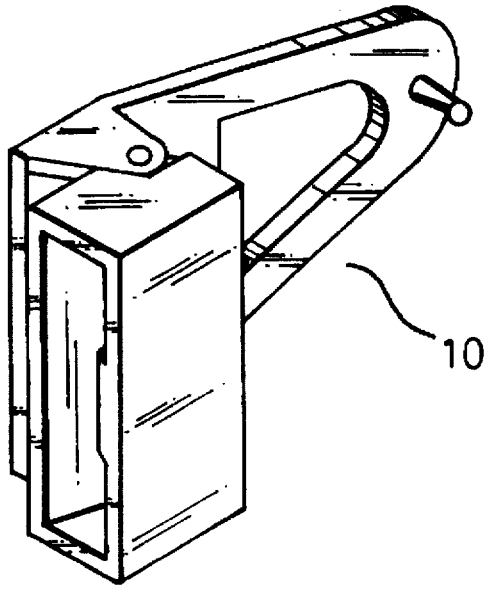
FIG. 5 is a second preferred embodiment of the male micro-adjustment buckle means of the present invention.
Figure 6:
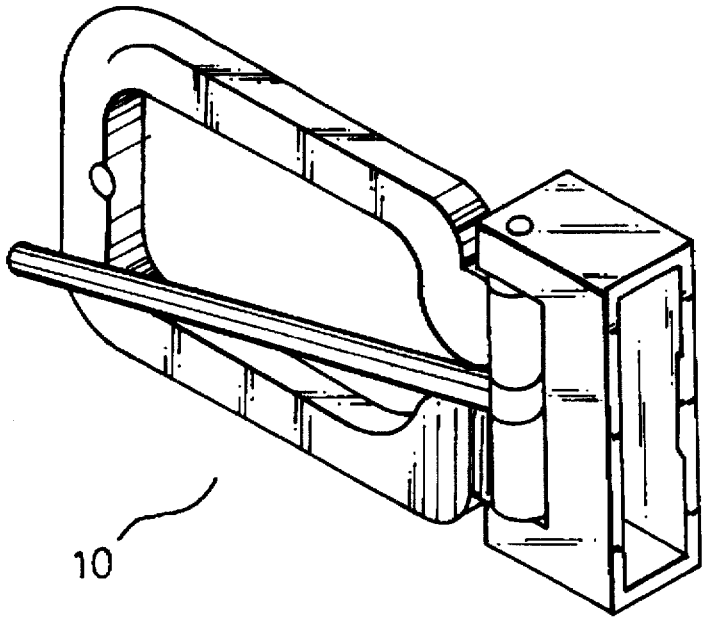
FIG. 6 is a third preferred embodiment of the male micro-adjustment buckle means of the present invention.
Figure 7:
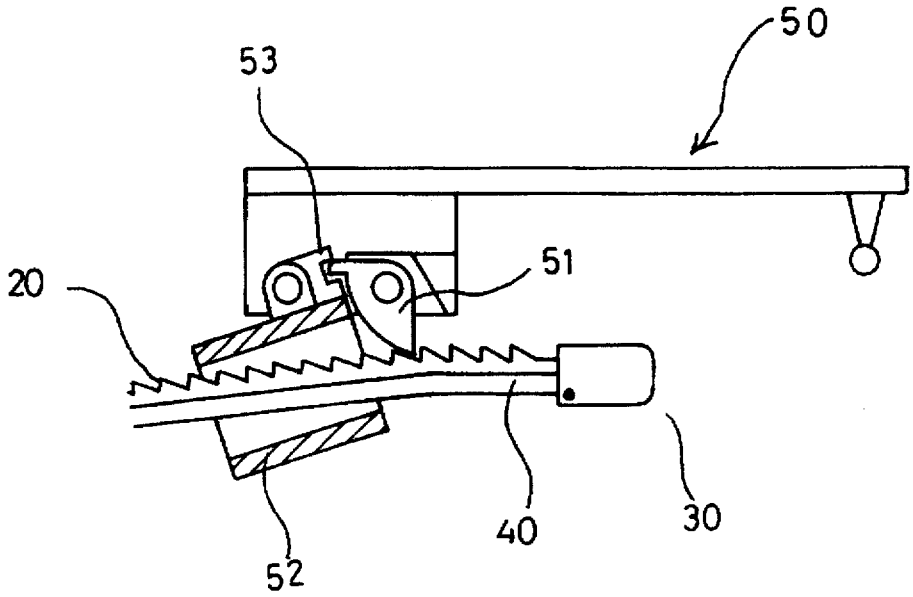
FIG. 7 is a second preferred embodiment of a micro-adjustment buckle means of the present invention.
Figure 8:
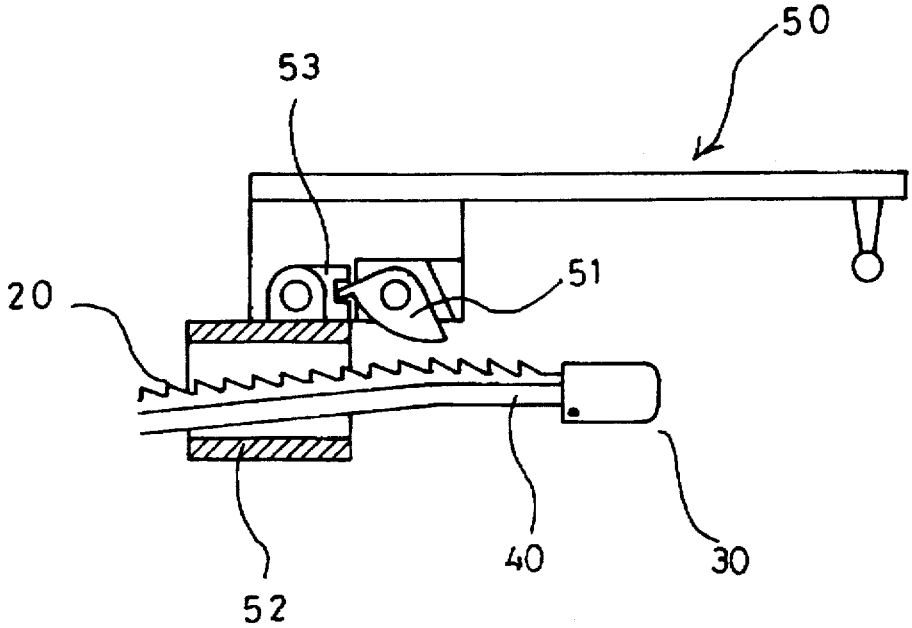
FIG. 8 is a schematic view of the second preferred embodiment of the micro-adjustment buckle means of the present, invention.
Figure 9:
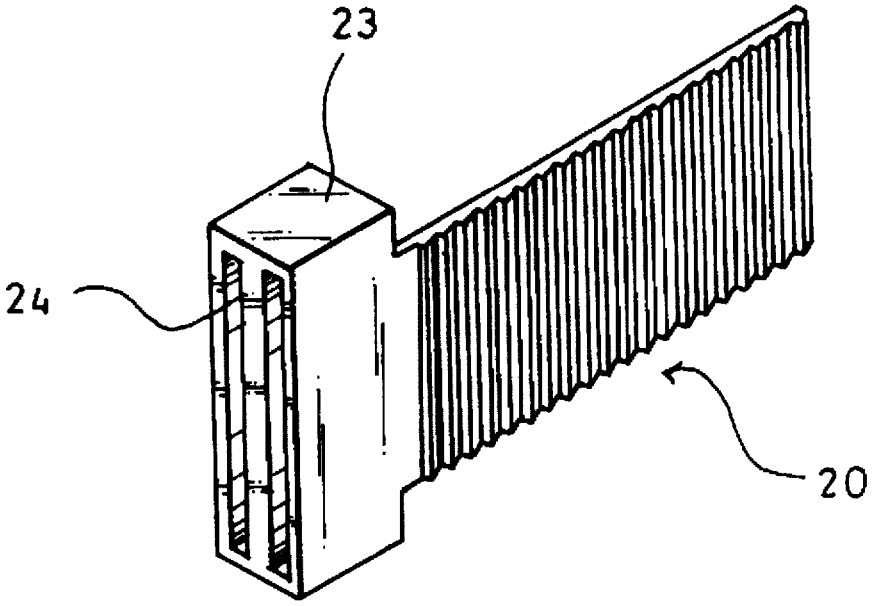
FIG. 9 is a second preferred embodiment of the male micro-adjustment buckle means of the present invention.

In addition to the common rectangular design of the male micro-adjustment buckle means 10, the male micro-adjustment buckle means 10 may also be configured to be any desirable geometrical shape (see FIGS. 5 and 6) to add variety to the belt and to attract consumers. In another preferred embodiment as shown in FIGS. 7 and 8, a lug 51 is hingedly provided at a lower portion of the female micro-adjustment buckle means 50 for engaging and retaining the male micro-adjustment buckle means 20. A concave block 53 is further provided at an upper portion of the female micro-adjustment means 50 for restricting angular movement of the lug 51. In this way, after the male micro-adjustment buckle means 20 is passed through the female micro-adjustment buckle means 10, the male micro-adjustment buckle means 20 is arranged on the outer side of the belt 40 and the fastener 30 may be secured in place, and the arrangement of the lug 51 provides a micro-adjustment function. In a still another preferred embodiment as shown in FIG. 9, the securing head 23 of the male micro-adjustment buckle means 20 is enlarged and is further provided with a restricting hole 24 for receiving the end of the belt tip after the belt tip is passed through the female micro-adjustment buckle means 10.

Although the present invention has been illustrated and described with reference to the preferred embodiment thereof, it should be understood that it is in no way limited to the details of such embodiment but is capable of numerous modifications within the scope of the appended claims.

What is claimed is:

1. A belt with micro-adjustment buckle means, comprising a female micro-adjustment buckle means, a male micro-adjustment buckle means and a fastener, said fastener consisting of a locking means pivotally connected to an inverted U-shaped frame, the belt and said male micro-adjustment buckle means being secured by said fastener by means of a plurality of engaging teeth on said locking means, wherein:

a micro-adjustment frame pivotally connected to a buckle plate of said female micro-adjustment buckle means by means of a pair of lugs, said micro-adjustment frame having a hollow interior inclining from an inlet end thereof having a comparatively greater diameter to an outlet end thereof having a comparatively smaller diameter, and a retainer having a slanting side being disposed at said inlet end of said micro-adjustment frame;

and said male micro-adjustment buckle means consists of a serrated plate of oblique teeth and a securing head disposed at a front end of said serrated plate for receiving an end portion of the belt.

2. A belt with micro-adjustment buckle means as claimed in claim 1, wherein said female micro-adjustment buckle means has a lug hingedly connected to a lower portion thereof for engaging the teeth of said serrated plate of said male micro-adjustment buckle means.

3. A belt with micro-adjustment buckle means as claimed in claim 1, wherein said securing head of said male micro-adjustment buckle means is further provided with a restricting hole for receiving an end of a belt tip after said belt tip has passed through said female micro-adjustment buckle means.

* * * * *